US006357614B1

(12) United States Patent
Kerr

(10) Patent No.: US 6,357,614 B1
(45) Date of Patent: Mar. 19, 2002

(54) NON-REFILLING DEVICES FOR CONTAINERS

(75) Inventor: Peter Douglas Kerr, Alloa (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/381,731

(22) PCT Filed: Mar. 17, 1998

(86) PCT No.: PCT/GB98/00795

§ 371 Date: Sep. 23, 1999

§ 102(e) Date: Sep. 23, 1999

(87) PCT Pub. No.: WO98/42587

PCT Pub. Date: Oct. 1, 1998

(30) Foreign Application Priority Data

Mar. 26, 1997 (GB) ..... 9706298

(51) Int. Cl.[7] ..... B65D 49/02

(52) U.S. Cl. ..... 215/21; 220/203.2; 222/495; 222/500

(58) Field of Search ..... 220/203.2; 222/495, 222/500; 251/324, 319, 356; 215/18, 25, 21, 22; 137/43, 533

(56) References Cited

U.S. PATENT DOCUMENTS

| | | | | | |
|---|---|---|---|---|---|
| 561,275 | A | * | 6/1896 | Pease | 215/21 |
| 1,042,622 | A | * | 10/1912 | Tucker | 215/21 |
| 1,134,885 | A | * | 4/1915 | Matson | 215/21 |
| 1,148,255 | A | * | 7/1915 | Re | 215/21 |
| 1,159,203 | A | * | 11/1915 | Folly | 215/21 |
| 1,775,292 | A | * | 9/1930 | Pinsuti | 215/21 |
| 1,842,594 | A | | 1/1932 | Erdner | |
| 1,994,625 | A | | 3/1935 | Tivoli | |
| 2,001,609 | A | * | 5/1935 | Greene | 215/21 |
| 2,038,392 | A | * | 4/1936 | Wandell et al. | 215/21 |
| 2,126,003 | A | * | 8/1938 | Greene | 215/21 |
| 2,200,761 | A | * | 5/1940 | Amaru | 215/21 |
| 2,257,515 | A | * | 9/1941 | Reynolds | 215/21 |
| 3,206,054 | A | * | 9/1965 | Militello | 215/21 |
| 3,757,980 | A | * | 9/1973 | Rundgren et al. | 215/21 |
| 4,217,988 | A | * | 8/1980 | Mills et al. | 215/21 |
| 4,258,854 | A | * | 3/1981 | Wright | 215/21 |
| 4,377,242 | A | * | 3/1983 | Snedker | 215/21 |
| 4,497,415 | A | | 2/1985 | Delonghi | |

FOREIGN PATENT DOCUMENTS

| | | |
|---|---|---|
| CH | 177923 | 1/1934 |
| EP | 0367427 | 10/1989 |
| EP | 0670271 | 2/1995 |
| FR | 809911 | 5/1936 |
| GB | 406540 | 6/1933 |
| GB | 555529 | 4/1942 |
| GB | 1002513 | 5/1962 |
| GB | 1138326 | 4/1966 |
| GB | 2008531 | 10/1978 |
| GB | 2026428 | 7/1979 |
| WO | 95/33660 | 6/1995 |
| WO | 96/04179 | 7/1995 |

* cited by examiner

*Primary Examiner*—Allan N. Shoap
*Assistant Examiner*—Tri M. Mai
(74) *Attorney, Agent, or Firm*—Diller, Ramik & Wight

(57) ABSTRACT

An in-bore non-refilling device for a bottle of fine spirits has a valve member 16 in the form of a regular dumbbell, with conical ends 62 arranged back-to-back and joined by a central shaft 63 at their apices. The housing 12 of the device has its bottom end closed by an annular bucket 14 which is snap-engaged into position, and each of the conical ends of the valve member has a toroidal free edge which is capable of making sealing engagement with a complementary surface 22 formed around the bucket aperture.

18 Claims, 4 Drawing Sheets

NON-REFILLING DEVICES FOR CONTAINERS

BACKGROUND OF THE INVENTION

This invention relates to non-refilling devices for containers of liquids such as fine spirits. The invention especially (but not necessarily) relates to such devices which are designed to be substantially or wholly received in the mouth region of the container; for brevity they are accordingly referred to hereinafter as "in-bore non-refilling devices".

In-bore non-refilling devices may be used in association with a capsule or closure which has a generally plane crown to overlie the container mouth, and a tubular skirt which depends peripherally from the crown and is adapted to embrace the container outside the non-refilling device. Often, the capsule is of thin metal, and to attach it removably to the container has thread formations rolled into its skirt when it is in its fitted position on the container. The threads are conformed automatically to underlying threads on the container to provide a required threaded engagement between the two.

Usually, at the same time as the thread is formed the free edge of the skirt is rolled inwardly under an annular shoulder of the container so as in combination with a line of weakening formed around the skirt to form a tamperevident or security band. When the closure is unscrewed for the first time this band separates from the remainder of the closure, thereby leaving visual evidence that an attempt has been made to open the container. A closure of this kind is usually referred to as a ROPP (Roll-On PilferProof) closure.

Whilst such a tamperevident arrangement may provide a high degree of security for a ROPP closure, it may be possible for a potential tamperer to remove the closure leaving the tamperevident band intact, and to reinstate the closure to visually its original state after adulterating or otherwise changing the liquid contents of the container. In-bore non-refilling devices are intended to avoid this possibility by preventing the addition of a liquid or solid substance through the container mouth.

Some earlier proposals of in-bore non-refilling devices are shown in Patent Publications U.S. Pat. No. 4,258,854, GB 2026428A, and WO 96/04179. From those and other similar publications it will be seen that the device essentially comprises a hollow housing which can be push-fitted into the container mouth and suitably retained in position, and a valve member received and held movably captive within the housing and capable of engaging a valve seat provided by the housing so as to prevent an adulterant from being introduced into the container, whilst allowing liquid flow in the other direction for dispensing in the normal way.

In WO 96/04179 the device has a closure disc having a peripheral margin which is arranged to overlie the rim of the container in sealing relation and is capable of being engaged at its free edge with a closure or capsule so that the device and the closure or capsule can be applied as one when the container is closed initially at the bottling plant. The closure disc is removably attached to the housing of the device so that removal of the closure or capsule also removes the disc, leaving the housing with the valve member still retained in the container. Furthermore, in WO 96/04179 the housing is arranged to provide a valve guard by which to prevent direct access to the valve member by an implement (e.g. tweezers or wire) or a water jet in an attempt to dislodge the valve member.

A further proposal for an in-bore non-refilling device is described and claimed in GB patent specification No. 2008531B owned by the present Applicants. In that specification the device has a housing, valve member and valve guard as previously discussed. In addition it has, as an additional anti-tampering feature, an arrangement of the housing in two parts which are integrally formed by frangible bridges. Any attempt to remove the device from the container, for example by engaging a hooked wire with the accessible upper part of the device, will result in fracturing of the bridges, so leaving evidence of the tampering.

SUMMARY OF THE INVENTION

The present invention seeks to provide a non-refilling device having desirable features such as are variously described above but integrated together in a manner which in relative terms is cheap to mould and easy to assemble and apply to a container, and which furthermore provides in use a high degree of security against tampering, and satisfactory pouring.

In accordance with the invention from a first aspect there is therefore provided a non-refilling device which is insertable at least in part in a container neck, characterised in that the valve member of the device has two valve heads arranged back-to-back and each having a circular sealing face which may serve for sealing. Advantageously each valve head is generally conical, the conical surfaces of the valve heads being in generally spaced opposition to one another along the valve member.

The valve heads may be joined together by a central shaft of substantially smaller cross-sectional dimensions than the valve heads, and radially projecting webs may extend between the valve heads and the central shaft (if provided) to control product flow past the valve member.

The webs may terminate in free edges which extend linearly between the outside peripheries of the valve heads, but in a preferred arrangement the free edge of each web is formed of two equal and oppositely inclined edge portions so that it forms a triangular projection beyond an imaginary line joining the valve heads directly together. When the housing is in position in the container neck the outer ones of the edge portions may cooperate with a correspondingly inclined, interior surface of the housing to determine the dispensing position of the valve member in the body and prevent the valve member from being removed by a tamperer.

In accordance with the invention from a second aspect there is provided a non-refilling device for a container neck, which comprises:

a) tubular housing insertable into the container neck and having engagement means to maintain it in that position, the housing being hollow and having apertures at inner and outer ends thereof to allow product to flow along the housing for dispensing, the inner end having a said aperture surrounded by a valve seat;

b) a valve member held loosely captive within the housing for sealing engagement with the valve seat; and c) a closure disc separably engageable with the outer end of the housing and having a peripheral margin by which it is permanently engageable with a closure to be located over the container neck, when the closure and device and in closing relation with the container the peripheral margin of the closure disc overlying the container rim but the closure disc being separable from the housing so that the closure can be removed together with the closure disc leaving the housing and valve member in place for dispensing product, the device being characterised by an outwardly projecting thin and compliant flange formed around the housing at a position to be interposed between the container rim and the peripheral margin of the closure disc, in sealing relation with both the container rim and the peripheral margin.

Two embodiments of the invention will now be described by way of example and with reference to the accompanying drawings.

In the drawings:

EMBODIMENT OF FIGS. 1 TO 5

Figure 1:
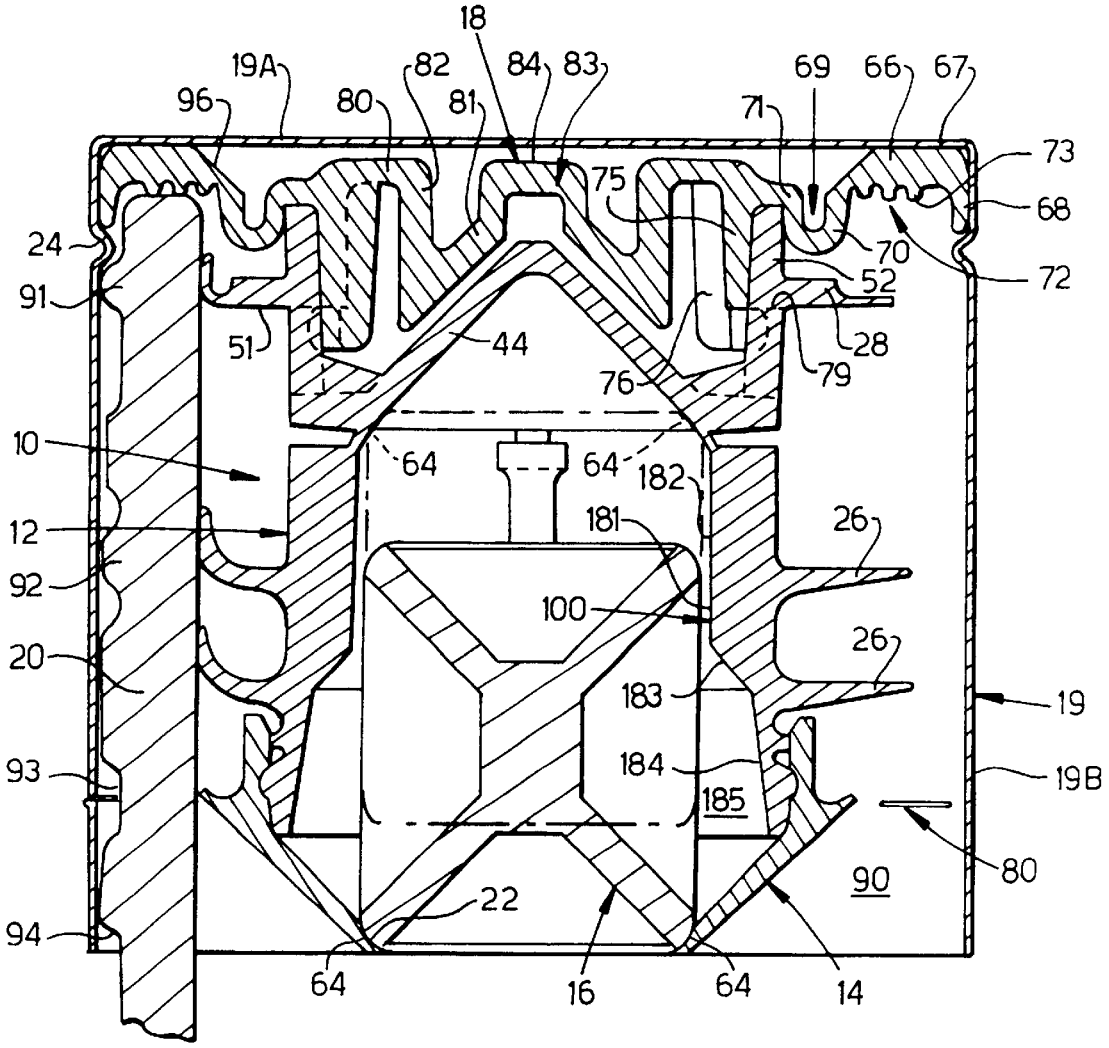
FIG. 1 shows a first in-bore non-refilling device embodying the invention in central vertical section, its right and left hand halves showing the device respectively as it appears before and after insertion into a bottle neck.

Referring firstly to FIG. 1 of the drawings, an in-bore non-refilling device 10 for a glass bottle of fine spirits such as Scotch Whisky is formed of four plastics components which are respectively numbered 12, 14, 16 and 18. The device is associated with a capsule or shell 19 of the well-known ROPP variety and which forms part of a screw-on closure for the bottle as will be described. The capsule is stamped from aluminium, and has a generally plane crown 19A and a tubular skirt 19B. Near its free end the skirt is formed with a circumferential line of weakening 80 formed by spaced slits and defining a tamperevident band 90. In addition, an inwardly extending retaining bead 24 is formed around the skirt at a small distance from the crown 19A.

The bottle neck is represented on the left hand side of FIG. 1 and denoted by the reference numeral 20. On its generally cylindrical exterior surface it is formed with a stop bead 91 for engagement with the retaining bead 24 on the capsule to define the axial position of the capsule on application. It is further formed with screw threads 92, a recess 93 for the line of weakening 80, and a shoulder 94.

The four components of the device 10 are: a hollow housing body 12 having an open bottom (as shown) end, an end closure member 14 snap-engaged over the bottom end of the body 12 and having a circular (in plan elevation) central hole 21 defined by a valve seat 22, a valve member 16 disposed inside the body and held captive there by the end closure member for sealing engagement with the valve seat, and a generally plane closure disc 18 snap-engaged with the body but held captive by the capsule 19 by means of the bead 24. The body and the end closure member together form a housing for the valve member. More detailed descriptions of the components 12, 14, 16 and 18 will now follow.

THE BODY (12)

Figure 2:
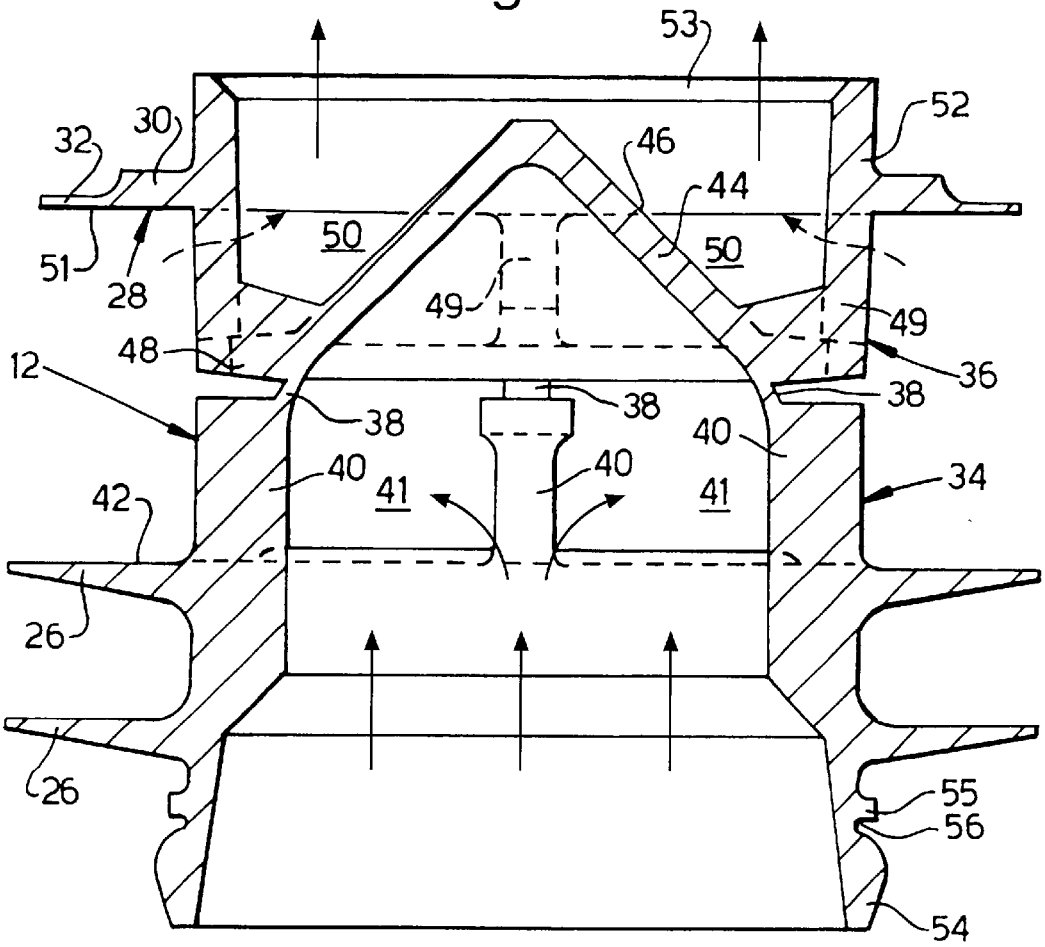
FIGS. 2, 3 and 4 show respective individual components of the first device as moulded and at least partly in central vertical section.

The body 12 is injection-moulded from polypropylene and is shown individually in FIG. 2. It is generally cylindrical, and has flexible and outwardly projecting fins 26, 28 formed integrally around its circumference. Two of these fins (26), near the lower end of the body, are identical and taper progressively towards their free ends. A further fin 28 is disposed near the upper end of the body at a substantially greater spacing from the uppermost fin 26 than the spacing of the fins 26 themselves. It has a smaller diameter than the fins 26, and in cross-section is seen to have a relatively rigid root portion 30 and a much thinner and flexible outer margin 32.

The two fins 26 on the one hand and the single fin 28 on the other hand are formed on respective lower and upper parts 34, 36 of the body which are joined frangibly together by four rupturable bridges 38 of small cross-sectional dimensions. The bridges are formed on four vertical (i.e. axially extending) posts 40 which are spaced regularly and widely apart around the lower body part 34 with their bases on approximately the same transverse plane as the upper flank 42 of the uppermost fin 26. The spaces 41 between the posts form part of the dispensing flow path for whisky to leave the bottle, as will be described.

The bridges 38 are formed on the inner edges of the posts 40, and they are joined to the upper body part 36 around the base of a conical central portion 44 of the latter. This central portion is imperforate; in use of the device 10 it provides an antitamper guard for the valve member 16, its conical upper surface 46 tending to deflect outwardly out of harm's way any wire or other implement used for tampering.

Radially outside the bridges 38 the central portion 44 is extended outwardly as a continuous annular flange 48, and four posts 49 spaced by gaps 50 rise from the outer periphery of this flange in alignment with the posts 40 of the lower body part 34. The posts 49 terminate at the lower flank 51 of the upper fin 28. Above the fin 28 the upper body part 36 continues as a short unbroken collar 52 which extends upwardly beyond the apex of the central portion 44 to a free edge 53. This free edge is internally chamfered to assist assembly.

The interior cavity of the body, within which the valve member 16 will be held captive and movable for dispensing, has a restricted throat defined by an upper part 182 of the interior surface 100 of the lower body portion 34—see FIG. 1. The throat is cylindrical and dimensioned to make a small clearance 181 with the valve member as shown. Its top end is closed—(in a manner to allow product flow)—by the frangible upper body part 36. Below the throat the body cavity widens at minor and major frustoconical surfaces 183, 184 so as with the upper surface of the bucket 14 to form an annular chamber 185 into which the lower free edge 64 of the valve member 16 may move for a normal dispensing operation.

At the bottom of the body 12, below the lowermost fin 26, the lower body part 34 is formed externally with a snap-engagement bead 54 backed by a control bead 55, the beads 54, 55 being separated by a relief groove 56.

THE END CLOSURE MEMBER (14)

Figure 3:
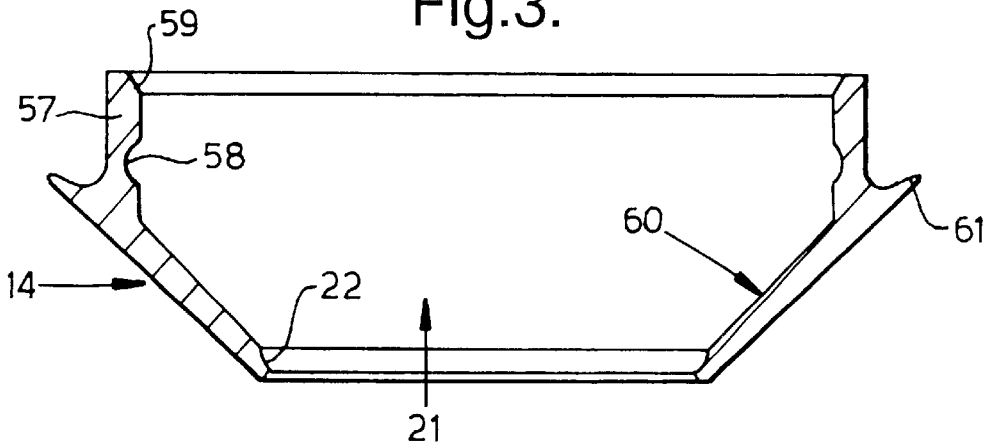

The end closure member 14 (FIG. 3) is injection-moulded from polypropylene and in order to form the housing for the valve member 16 is arranged for snap-engagement on the lower part 34 of the body (12) at its beads 54, 55 as is shown in FIG. 1. For that purpose the end closure member has a generally cylindrical, distendable upper collar 57 which is formed internally with a snap-engagement groove 58. The collar also has an internally chamfered free edge 59 for assisting assembly.

Below the collar 57 the end closure member has a generally rigid and frustoconical, inwardly and downwardly inclined portion 60 which is extended upwardly beyond its attachment to the collar as an outwardly projecting continuous nose 61.

The frustoconical portion 60 terminates at its bottom end in the circular hole 21 mentioned previously. The valve seat 22 for the hole is provided by a toroidal surface which is formed on the free inner edge of the frustoconical portion.

When the fitment is being fitted to a bottle neck as is later described, the conical lower surface of the end closure member initially centralises the fitment in relation to the neck. Thereafter guidance for the fitment during its insertion is provided by the nose 61.

THE VALVE MEMBER (16)

The valve member 16 (FIG. 4) is injection moulded from polypropylene. It is generally in the form of a regular dumbbell, having two identical open-ended conical large end portions or heads 62 joined at their apices or smaller end portions by a solid central shaft 63 which extends symmetrically along the center line XX of the valve member. The end portions have walls of a uniform thickness, and their free edges 64 are toroidal and complementary to the valve seat 22 of the end closure member 14. The free edges are circular as seen in plan elevation, and they surround conical concavities 95 which are formed by the interior surfaces 6 of the end portions.

Plane and longitudinally extending webs 65 join the conical exterior surfaces 7 of the end portions 62 to one another and to the cylindrical outer surface 8 of the shaft 63. The webs, which are spaced regularly around the valve member, provide rigidity for the valve member and help to control the flow of product longitudinally through the housing during dispensing.

Figure 4:
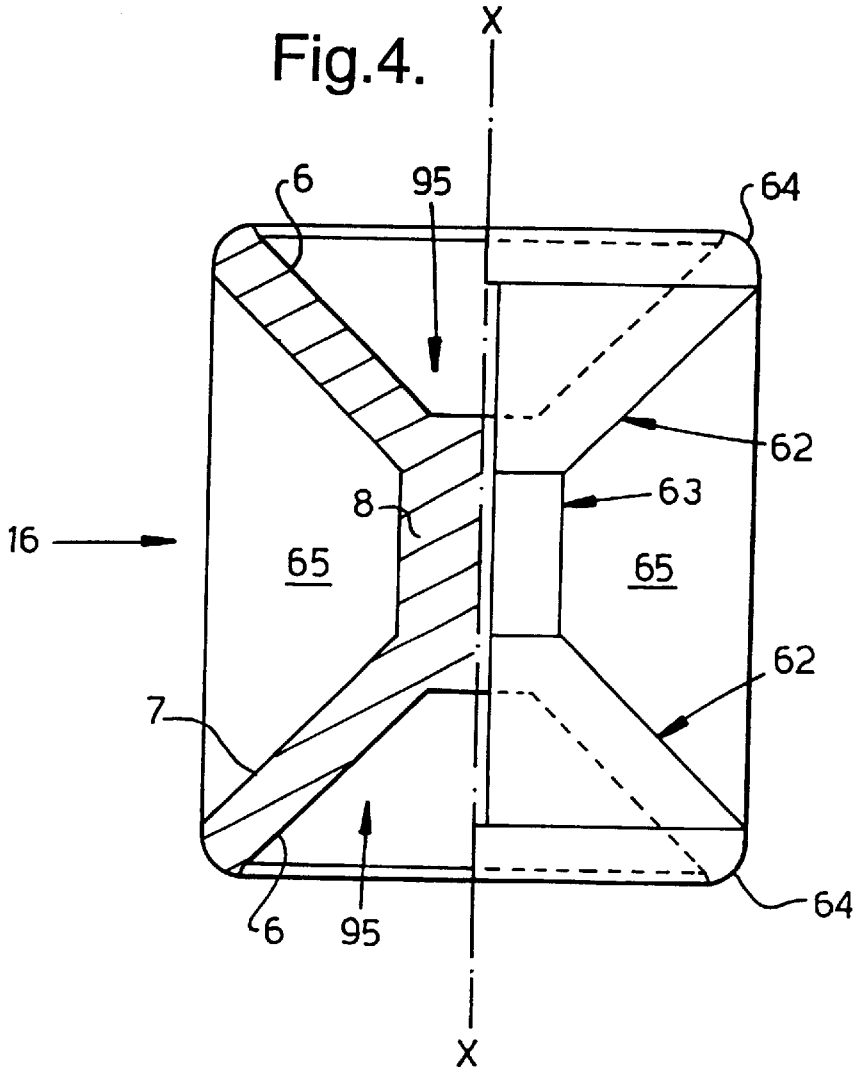

As depicted in FIGS. 1 and 4 the valve member 16 has four webs 65 regularly spaced at 90 ° intervals around its circumference. A number of webs other than four is possible, but Applicants have found that for best results the number of webs should be even; thus two or six webs may be used, but four is preferred.

THE CLOSURE DISC (18)

Figure 5:
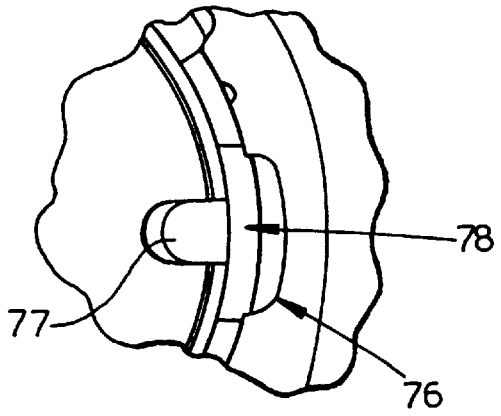
FIG. 5 is a scrap view showing part of the fourth component of the first device as seen from beneath.

The closure disc 18 (FIGS. 1 and 5) is injection-moulded from low density polyethylene so as to have a substantially soft and conforming nature. It has the form of a substantially plane but corrugated disc, and has an elevated outer rim 66 with an annular upper surface 67 and a downturned free edge 68. Immediately adjacent and inside the rim the closure disc has an upwardly open peripheral groove 69 having outer and inner arms 70, 71.

With the rim 66 the outer arm 70 of the groove 69 forms a downwardly open groove 72 in which the rim of the bottle 20 may be snugly received and sealed—see FIG. 1. For that purpose the undersurface of the rim 66 within the groove 72 may be formed with a number of concentric, compliant and downwardly projecting, circular sealing beads 73 of which three are shown. Alternatively the undersurface may be flat and unribbed; in a further alternative the undersurface is again unribbed, but is inclined downwardly and outwardly at an angle of 6° to the horizontal.

The closure disc 18 has a further, downwardly open, groove which is formed concentrically within the grooves 69, 72 and which is capable of receiving the collar 52 of the body 12 in sealing relation as is illustrated in FIG. 1. This additional groove is defined on its outside by the inner arm 71 of the groove 69; on its inside it is defined by a collar 75 which extends downwardly from integral attachment to the closure disc at its top end. For clarity the groove is not separately referenced.

Nine catch members 76 are spaced regularly around the collar 75. As is apparent from FIGS. 1 and 5 in combination, each catch member has a shaft 77 formed as a vertical rib down the inside of the collar, and a head 78 which is carried by the shaft at the bottom edge of the collar and which projects radially outwardly beyond the collar at an upwardly facing shoulder 79 (FIG. 1).

The catch members 76 are resiliently deformable, and their shoulders 79 are capable of snap-engaging beneath the free lower flank 51 of the body fin 28 between the posts 49, to attach the closure disc 18 and the body 12 releasably together. See the catch member which is particularly shown on the right hand side of FIG. 1.

Within the collar 75 and its catch members 76 the closure disc 18 has, in succession in the radially inward direction, an upper annulus 80, a lower frustoconical portion 81 having its outer periphery joined to the annulus 80 by a generally cylindrical ring 82, and a boss 83 upstanding from the inside of the frustoconical portion 81 at the centre of the closure disc.

The top surface 84 of the boss lies on approximately the same level as the upper surface of the annulus 80, both surfaces being disposed at a slightly lower level than the upper surface 67 of the rim 66. When, as shown in FIG. 1, the closure disc is snap-engaged with the body 12, the frustoconical portion conforms and lies closely adjacent to the central portion 44 of the body so as to cushion the central portion, and thereby the upper part 36 of the body, against any shock loading of product when, for example, the bottle is inverted. In addition, the junction between the rim 66 and arm 70 of the closure disc is made highly flexible by the provision of a chamfer 96, so that lateral adjusting movement of the device 10 in relation to the capsule 19 is possible. The closure disc accordingly provides protection against premature rupturing of the bridges 28 when the bottle is closed.

ASSEMBLY AND USE

The device 10 is assembled by inserting the valve member 16 into the body 12 and by snap-engaging the end closure member 14 onto the body to complete the housing for the valve member and hold the valve member loosely captive. No angular orientation is required for any of the components, and the valve member can be inserted with either end portion 62 leading. At a suitable time the body is snap-engaged with the closure disc 18 to complete the device; again no angular orientation of either component is required.

The device is pushed into the ROPP capsule 19 with its closure disc 18 leading. The downturned edge 68 of the closure disc thereby becomes snap-engaged behind the bead 24 which has been preformed on the capsule for that purpose. The assembly of device 10 and capsule 19 is then as it appears on the right hand side of FIG. 1, and is ready for use in a bottling plant.

In the bottling plant the device 10 fitted with the capsule 19 is pushed into the neck of a product-filled bottle, and becomes lodged there by frictional and wedging engagement of the fins 26, 28 with the bottle neck bore as shown in FIG. 1. In conventional manner screw threads (not shown) are then rolled into the capsule in conformity with the screw threads 92, and the free edge of the capsule is rolled under the shoulder 94 of the bottle neck to secure the tamper-evident band 90 to the bottle.

To open the bottle for consumption the user unscrews the capsule 19, thereby leaving the tamperevident band 90 on the bottle and separating the closure disc 18 from the remainder of the device 10 for removal with the capsule. Product can then be dispensed in the normal way by inverting the bottle, the valve member 16 lifting off its seat 22 to allow product flow. The upwardly flaring shape of the bucket 14 and the substantial clearance allowed by the chamber 185 enable product to flow freely around the free edge 64 of the valve member after passing the valve seat. The upper limiting position of the valve member is represented in FIG.

1 by ghosted lines and is determined by engagement with the central portion 44 of the upper body part 36.

In its passage through the non-refilling device 10 for dispensing, the product passes along the valve member 16 guided by the webs 65 and the adjacent surfaces of the end portions 62 and shaft 63 of the valve member. The upper end portion gives the product an advantageous outward component of direction. After leaving the valve member the product passes outwardly between the posts 40 to the exterior of the device, moves around the outside edge of the annular flange 48, and returns to the interior of the device via the gaps 50 between the posts 49. After the posts 49 it is recombined as a coherent product stream by the conical upper surface of the central portion 44 and the cylindrical inside surface of the collar 52.

The thin outer margin 32 of the upper fin 28 acts as a compliant feather edge capable of forming a liquid-tight seal with the bottle neck bore. Product flow from the bottle is thereby limited to the coherent stream emerging from the collar 52.

After dispensing has been completed, the bottle is inverted again to its upright position and the capsule is screwed back on the bottle, thereby snap-engaging the closure disc 18 again with the body 12 and reforming the liquid seal which the closure disc makes with the bottle by its beads 73. The reinversion of the bottle allows the valve member to fall back onto its seat 22, assisted by the weight of any product which collects in the cavity 95 on top of the valve member after returning via the gaps 41. The difficulty of refilling the bottle with a substitute product is therefore reestablished.

For seal security the bottom end of the valve member 16 is centralised by the downwardly inclined inner surface of the cone portion 60 of the bucket 14 and the complementary toroidal surfaces of the valve seat 22 and the valve member. At its top end the valve member is closely constrained against lateral movement by the throat formed by the surface 182 of the body; the clearance 181, whilst small (typically 0.25mm), enables the valve member to move freely in its longitudinal direction as required for dispensing and resealing.

Tamper-resistance for the device of FIGS. 1 to 5 is provided in known manner by the bridges 38, at which the body breaks in two if any attempt is made to remove the device by an implement inserted into the bottle neck after the capsule 19 and, with it, the closure disc 18 has been removed.

The double-ended, symmetrical configuration and plastics composition of the valve member 16 particularly shown and described give many advantages including those mentioned above. Amongst the other advantages of such an arrangement are:

(1) Being of thermoplastics material the valve member can be considerably lighter in weight than the glass balls which are often used, so reducing dynamic stresses on the bridges 38 in particular;

(2) Despite its lightness the valve member is inherently robust and dimensionally stable;

(3) By suitable choice of the length of the shaft 63 and webs 65 the valve member can be readily tailored to suit valve housings having different lengths; if desired the shaft 63 may be omitted entirely, and the end portions 62 be arranged directly back-to-back;

(4) By varying the lengths and/or the cone angle of its end portions 62 the valve member may be adapted for different diameters of valve seat and, therefore, discharge rates;

Whilst it is preferred for the cone angle of the end portions 62 of the described embodiment to be 90° as shown, other cone angles may be used. Furthermore, whereas the uniform wall thickness shown for the end portions is preferred, a varying wall thickness (e.g. tapering) may be used if desired.

The cavities 95 of the valve member 16 of the described embodiment are essentially conical, but it may be preferred to use other shapes of cavity; thus arcuate, e.g. hemispherical, cavities may be employed if desired.

The embodiment of the invention which is now to be described in relation to FIG. 6 again has a valve member again generally of regular dumbbell shape, but in this second embodiment the valve heads have substantially no cavity. Other modifications (in relation to the embodiment described above) are also employed.

EMBODIMENT OF FIG. 6

Figure 6:
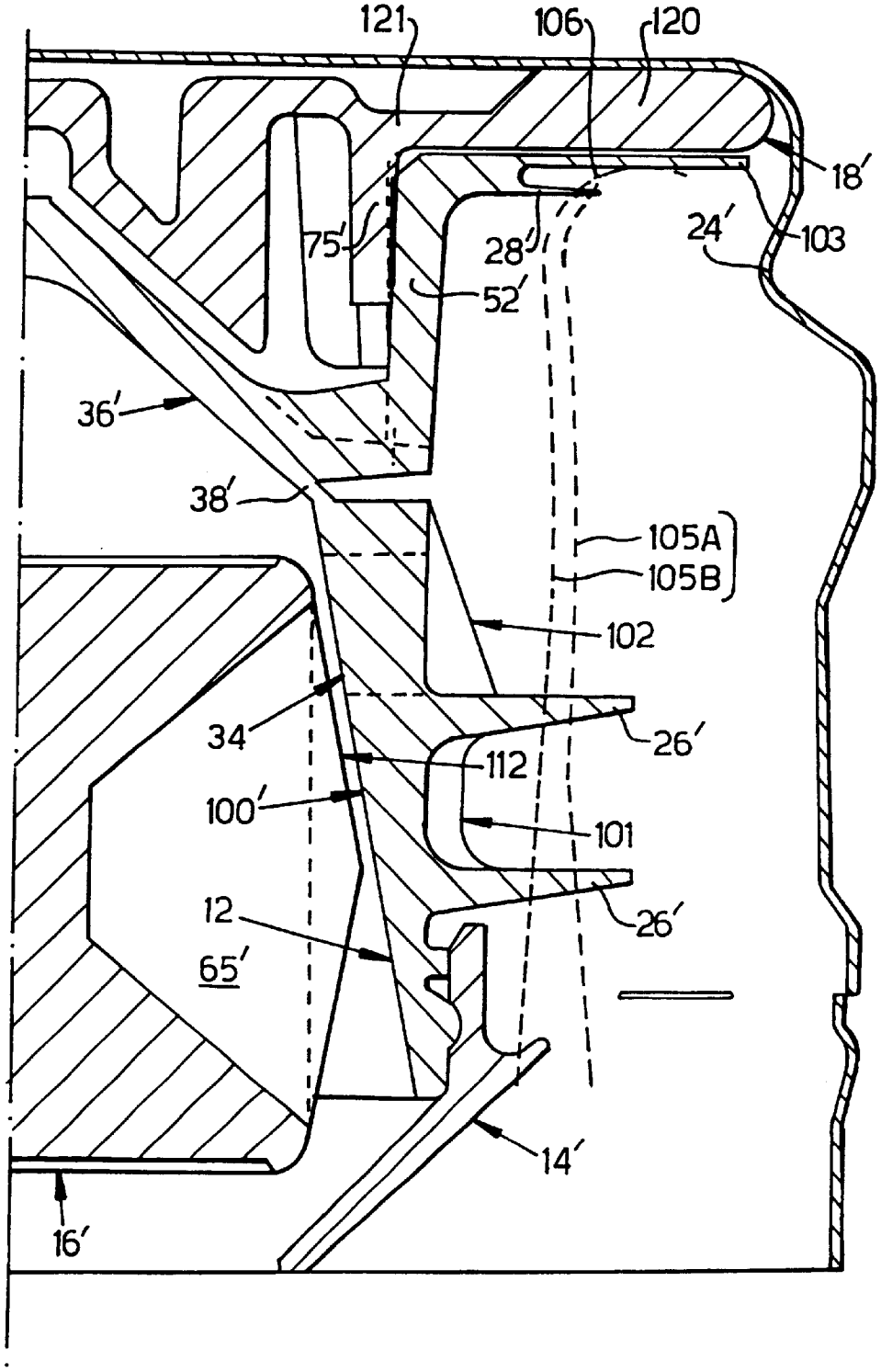
FIG. 6 shows the second device in accordance with the invention, as it appears in central vertical section on one side of its central axis.

The embodiment of FIG. 6 is similar in many ways to the embodiment described above with reference to FIGS. 1 to 5, and the same reference numerals are used, with primes, to denote like or analogous parts. As before, the device is formed of four plastics components, namely an open-bottomed hollow body 12', an apertured end closure member 14' snap-engaged over the bottom end of the body, a valve member 16' held captive inside the body by the end closure member and capable of making sealing engagement with the latter, and a closure disc 18' snapengaged with the body and located in a metal capsule 19' by a bead 24'. The body again has lower and upper parts 34', 36' with respective bottle-engaging fins 26', 28' and attached frangibly together by rupturable bridges 38'.

In its method of assembly and use this embodiment is exactly the same as the previous embodiment. However the body 12', the valve member 16' and the closure disc 18' are modified as will become apparent from the following descriptions of them individually.

THE BODY (12')

The LOWER PART 34' of the body is modified in the following respects:

(1) Instead of the stepped interior surface 100 of the lower body part 34 of the first embodiment, formed of the substantially cylindrical upper surface 182 and the frustoconical surfaces 183, 184 beneath it, in this embodiment the internal surface 100' of the lower body part 34' is purely frustoconical and tapers upwardly and inwardly as shown. The function and advantages of this arrangement will become apparent later.

(2) Four regularly spaced ribs 101 are formed around the outside of the body. Each rib extends vertically between the two fins 26' in alignment with a post 40 and merges with the fins at its ends so as to provide increased rigidity for the fins. In this way the ribs assist retention of the lower body part 34' in the bottle, especially if an attempt is made to pry it out of the bottle neck.

(3) Four further vertical ribs 102 are aligned with the ribs 101, one for each post 40. These further ribs buttress the posts from the upper fin 26' so resisting deformation of the posts by a screwdriver or the like in an attempt by a potential tamperer to extract the valve member 16' after the upper body part 36' has been broken away.

The UPPER PART 36' of the body 12' is modified in the following respect:

(1) In the embodiment of FIGS. 1 to 5, sealing with the bottle rim is achieved directly by the closure disc 18 (as has been described). However, in this embodiment the closure disc 18' is not required to seal with the bottle, but instead the body part 36' is formed with a thin and compliant annular flange 103 which projects outwardly from the top end of the collar 52' so as to be urged downwardly by the closure disc 18' into sealing relation against the bottle rim.

The compliant flange 103 is formed around the periphery of a thicker flange portion 104 which carries the fin 28' beneath it at a spacing from the compliant flange. As will be seen from FIG. 6 where the outer and inner limits of the bottle profile are shown at 105A and 105B respectively, the fin 28' is located and dimensioned so as to engage the inner radius 106 of the bottle neck bore, that is to say, immediately beneath the bottle rim. In comparison, in the first embodiment the fin 28 is carried at a lower level in relation to the bottle, for engagement with the generally cylindrical interior of the bottle neck.

THE END CLOSURE MEMBER (14')

Apart from some small dimensional changes the end closure member is as previously described.

THE VALVE MEMBER (16')

The valve member is, as before, generally in the shape of a regular dumbbell having two identical circular end portions or heads 62' joined symmetrically together by a solid central shaft 63' and by four longitudinally extending webs 65' disposed at 90° intervals around the shaft. However, the valve member 16' differs from that of the first embodiment in the following respects:

(1) The heads of the valve member are no longer hollow and formed with concavities at their ends. They are now solid, with plane end surfaces 110 which are substantially flush with the end terminations of the heads formed at the axial extremities of the toroidal sealing edges 64'.

Applicants have discovered experimentally that valve members (16) with concavities in their valve heads are sometimes reluctant to move from or to these valve seats, as is required for dispensing or resealing. The reason for this is not fully understood, but it is believed to arise from product voids which may occur in the concavities under some circumstances. By making the heads solid this problem has been substantially overcome, and in particular the device can be reliably used in an inverted vertical position in association with a bar optic.

(2) The free edges of the webs 65' do not extend linearly between the valve heads 62 at either end as in the first embodiment. Instead, they are formed of two mutually inclined straight edges arranged for the upper one 112 to make a parallel clearance 181' with the frustoconical internal surface 100' of the lower body part 34'. Any attempt by a potential tamperer to extract the valve member from above after the upper body part 36' has been broken away will be prevented by abutment of these edges 112 with the surface 100'. The same abutment also defines the upper position which the valve member adopts for normal dispensing.

THE CLOSURE DISC (18')

From its collar 75' inwardly the closure disc corresponds to the closure disc 18 of the first embodiment. However, the items 68 to 73 of the first embodiment are replaced by a more simple peripheral margin formed of a parallel-faced outer annulus 120 of substantial thickness, and a thinner inner annulus 121 which carries the outer annulus from the top of the collar 75' at a diameter to overlie the bottle rim.

As can be seen from FIG. 6, when the closure is in closing position on the bottle downward pressure exerted by the capsule from above on the outer annulus 120 will cause the latter to bear down on the compliant flange 103 of the body 12', so creating desired liquid-tight seals between the body and the bottle on the one hand, and between the body and the closure disc on the other hand. By virtue of its relation thinness the inner annulus 121 provides flexibility by which the natural compliance of the flange 103 is enhanced, so ensuring complete seal integrity. Applicants have found that a thickness for the inner annulus of between 0.25 mm and 0.30 mm gives satisfactory results.

The modifications of the device which have been described above in relation to FIG. 6 need not necessarily be used in combination with one another. Likewise, the originals of those modified features, described with reference to FIGS. 1 to 5, need not necessarily be used in combination. In particular, within the scope of the invention are devices having one or more of the unmodified features of the first embodiment in combination with one or more of the modified features of the second embodiment. Thus, for example, in two possible variants of the first embodiment the valve heads are solid (rather than formed with concavities), and sealing with the bottle rim is preformed by the body which is formed with an outwardly projecting thin and compliant flange for that purpose.

Although a preferred embodiment of the invention has been specifically illustrated and described herein, it is to be understood that minor variations may be made in the apparatus without departing from the spirit and scope of the invention, as defined the appended claims.

What is claimed is:

1. A valve for a container neck comprising a one piece integrally molded valve member having two valve heads, each of said valve heads being of a substantially conical configuration defined by a substantially conical body portion and substantially axially opposite respective relatively diametrically large and small end portions, said small end portions being disposed more closely adjacent each other than said large end portions, and each conical body large end portion having a terminal end defining a substantially circular sealing face adapted to seal against an associated valve seat.

2. The valve for a container neck as defined in claim 1 wherein each sealing face is part toroidal.

3. The valve for a container neck as defined in claim 1 including a central portion joining said valve heads to each other at said small end portions.

4. The valve for a container neck as defined in claim 1 including a central portion joining said valve heads to each other at said small end portions, and said central portion being of a substantially smaller radial cross-section than a radial cross-section through said large end portions.

5. The valve for a container neck as defined in claim 1 including a central portion joining said valve heads to each other at said small end portions, and said central portion being of a radial cross-section corresponding substantially to a radial cross-section through said small end portions.

6. The valve for a container neck as defined in claim 1 including a plurality of circumferentially spaced radially extending webs spanning said conical body portions.

7. The valve for a container neck as defined in claim 6 wherein there are an even number of said webs spaced in substantially equal circumferentially spaced relationship from each other.

8. The valve for a container neck as defined in claim 6 wherein there are four webs spaced in substantially equal circumferentially spaced relationship from each other.

9. The valve for a container neck as defined in claim 1 wherein each conical body portion includes a substantially axially opening cavity, and said axially opening cavities open in axially opposite directions.

10. The valve for a container neck as defined in claim 1 wherein each circular sealing face merges with an axial endmost surface lying in plane substantially normal to a longitudinal axis of said valve member.

11. The valve for a container neck as defined in claim 1 including a valve housing defined by a valve body housing and an end closure collectively defining a valve chamber, means for snap-securing together said valve body housing and said end closure, said end closure defining a valve seat and an associated valve seat opening, and said valve member being housed for axial movement in said valve chamber to selectively open and close said valve seat opening upon one of said circular sealing faces respectively moving away from and seating upon said valve seat.

12. The valve for a container neck as defined in claim 11 wherein said valve seat is defined by a substantially frusto-conical wall portion reducing inwardly toward said valve seat opening.

13. The valve for a container neck as defined in claim 11 wherein said valve seat is defined by a substantially frusto-conical wall portion reducing inwardly toward a valve seat opening, said frusto-conical wall portion merges with a substantially cylindrical wall portion, and said snap-securing means are defined by said cylindrical wall portion and said valve body housing.

14. The valve for a container neck as defined in claim 11 wherein said valve body housing includes means for engaging an inner surface of a container neck for retaining said valve body housing therein.

15. The valve for a container neck as defined in claim 14 wherein said valve body housing includes another opening at an end thereof axially opposite said valve seat opening, a closure disc for closing said another opening, said closure disc having a peripheral margin, a container neck closure, cooperative means between said container neck closure and said disc peripheral margin for effecting separation of said closure disc upon the removal of said container neck closure from an associated container neck, and said valve housing body having an outwardly projecting circumferentially extending thin and compliant flange adapted to be disposed between said closure disc peripheral margin and said container neck closure.

16. The valve for a container neck as defined in claim 15 wherein said compliant flange is in sealing relationship with said closure disc peripheral margin and a lip of said container neck.

17. The valve for a container neck as defined in claim 16 wherein the thickness of the compliant flange is within the range of 0.25 mm to 0.30 mm.

18. The valve for a container neck as defined in claim 16 wherein the compliant flange is made of polypropylene and the closure disc is made of low density polyethylene.

* * * * *